US006638134B1

(12) United States Patent
Hewitt

(10) Patent No.: US 6,638,134 B1
(45) Date of Patent: Oct. 28, 2003

(54) VERTICAL BOARDING TOY HAVING A THIN FLAT-FACED TRACK JUMPING SPINNER

(76) Inventor: Peter L. Hewitt, 246 School St., Acton, MA (US) 01720

( * ) Notice: Subject to any disclaimer, the term of this patent is extended or adjusted under 35 U.S.C. 154(b) by 31 days.

(21) Appl. No.: 10/050,703

(22) Filed: Jan. 18, 2002

(51) Int. Cl.[7] ..... A63H 29/08
(52) U.S. Cl. ..... 446/168; 273/120 R
(58) Field of Search ..... 446/168, 169, 446/170, 171, 172, 173, 174, 92; 273/120 R, 121 B, 288, 138.1

(56) References Cited

U.S. PATENT DOCUMENTS 1,279,988 A * 9/1918 Cole
3,206,209 A * 9/1965 Farrah
5,855,501 A * 1/1999 Kato et al. ..... 446/171
6,056,620 A * 5/2000 Tobin ..... 446/168

* cited by examiner

*Primary Examiner*—Jacob K. Ackun
*Assistant Examiner*—Jamila Williams
(74) *Attorney, Agent, or Firm*—Robert Nathans

(57) ABSTRACT

A rotating spinner travels down a number of track segments by the force of gravity, the spinner jumping across gaps separating the track segments and yet remaining in an upright position to enable reliable transfer of the spinner across the gaps. This is accomplished by designing the back spinner disk to have a weight that counterbalances the weight of the front spinner disk for thwarting tilting of said spinner member. The flat face of the spinner disk is large to display a large graphic design that moves as the spinner is transported down the track segments. A target member receives the spinner upon termination of its travel along the head-to-tail positioned track segments, and the skill level is changed by changing the gap sizes between track segments and the positions of the magnetized track segments supported upon a refrigerator door by force of gravity.

28 Claims, 4 Drawing Sheets

VERTICAL BOARDING TOY HAVING A THIN FLAT-FACED TRACK JUMPING SPINNER

BACKGROUND OF THE INVENTION

The present invention relates to the field of toy construction sets.

Marble track construction toys are known in the art whereby a spherical marble is pulled along a number of vertically oriented track segments by the force of gravity. In U.S. Pat. No. 6,056,620 issued to Tobin, a marble track having a number of separated track segments is constructed upon a vertical surface such as the door of a refrigerator. The track components include marble containing U-shaped chutes, tilted downwardly to enable gravity to pull the marble along the path of the track segments by gravity. As illustrated in the sole figure of the Tobin patent, the marble transporting track segments or chutes are magnetically mounted upon a paramagnetic refrigerator door. Various bumper devices for reversing the direction of the marble exiting one track segment chute to be inserted into the entrance of another U-shaped track segment chute are provided such as bumper 140. Other types of direction reversing devices are provided between the U-shaped track chutes having relatively complex pivotable elements 120. As in the present invention, the track segments and direction reversing devices can be vertically positioned upon the refrigerator door, to create a downward marble transport path that can be made infinitely variable.

However, the marble transport members of the Tobin patent extend a considerable distance from the vertical oriented wall of the refrigerator. This is readily apparent from reading the patent description along with viewing the sole figure. This is a disadvantage because relatively bulky components can be knocked off of the refrigerator door and thus create danger of slipping on such objects on the floor and/or breaking them.

SUMMARY OF A PREFERRED EMBODIMENT OF THE INVENTION

In contrast with the aforesaid prior art, the present invention provides components that do not protrude very far from the refrigerator door, and the resulting component flatness deters dislodging the components from the door. Furthermore such flatness eases mailing of the components via the postal system. Also, the manufacturing costs and cost of shipping the flat components are relatively small compared to the Tobin marble transport members.

The desired flat and compact arrangement of the present invention is attained by altogether eliminating the spherical marble riding in the aforesaid U-shaped transport chutes and replacing the marble with a thin flat-faced spinner member having a narrow axle that rides on an upper edge portion of the flat track segments, magnetically positioned upon a refrigerator door. The spinner member has a large diameter front flat-faced disk that simulates a large marble that would require wide U-shaped track chutes which extend even further from the door which is undesirable as discussed. Also, the vertical side walls of the prior art U-shaped chutes partially obscure the marble transported therein, which is undesirable.

Another very important advantage of my larger, flat-faced spinner, is that it is less likely to be swallowed by a child, in contrast with the marble; also the marble can more readily roll under the refrigerator or other pieces of furniture and can be a nuisance to retrieve. Since the front disk and flat track segments are relatively large and flat compared to a marble, it is easier to apply more dramatic colorful graphic designs to both the flat track segments and rotating front disk. For example a spiral motif can be interesting as the spinner rotates while it descends along the path defined by the tracks. The spinner thus can convey the visual impression of a giant marble. If the prior art were to use a very large marble to achieve the same benefits, the aforesaid U-shaped tracks would be very wide and the entire toy would be very bulky and cumbersome.

BRIEF DESCRIPTIONS OF THE DRAWINGS

The various features and advantages of the invention will become more apparent upon reading of the following description, taken in conjunction with the drawings in which.

DETAILED DESCRIPTION OF PREFERRED EMBODIMENTS OF THE INVENTION

Figure 1:
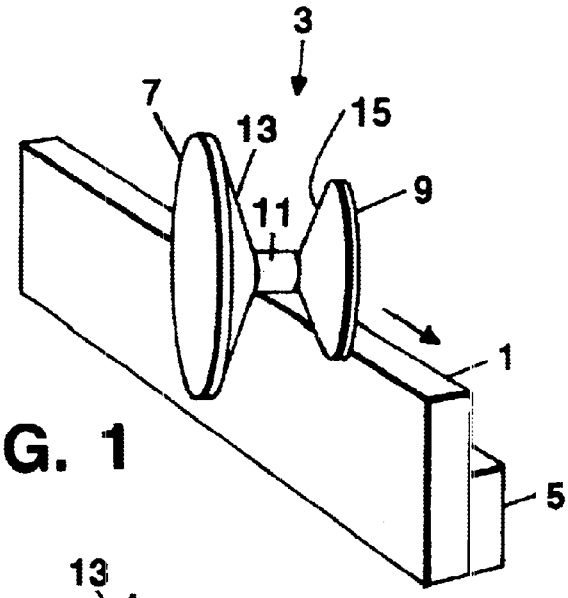
FIGS. 1 and 2 show the spinner positioned upon a track segment.
Figure 2:
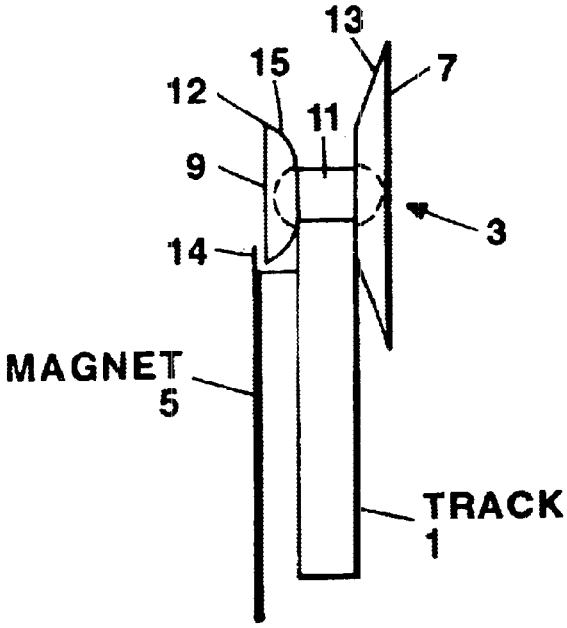
Figure 3:
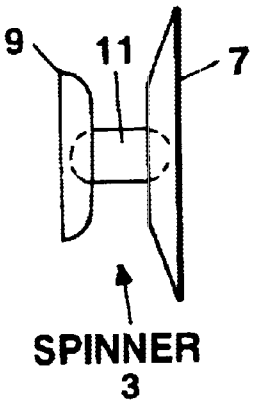
FIGS. 3 and 4 show side and front views of the spinner segment respectively.
Figure 4:
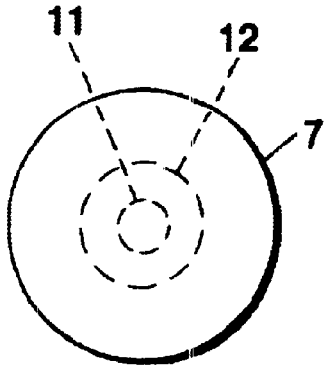

In accordance with the currently most preferred embodiments of the invention, a spinner member 3 is provided shown in FIGS. 1–4, including a short spin axle 11 having a large diameter flat front disk 7 affixed to a first terminal axle portion and a back disk 9 of a smaller diameter, affixed to a second terminal axle portion, and wherein the smaller back disk 9, due to its greater density, has a weight that counterbalances the weight of the front disk 7 for thwarting detrimental tilting of the spinner member as it rides downwardly along the relatively flat vertically oriented track segments 1, shown in FIGS. 1, 2, 6 and 7, and as the spinner member 3 jumps across gaps 2 formed between the track segments. Also, the front and back spinner disks are separated by a distance along the spinner axle 11 that is slightly greater than the width of top edge portions of the track members contacting said spinner axle as shown in FIG. 2, and thin magnets 5 maintain the thin flat track segments in position upon a vertical support surface. Due to the large flat areas of the tracks and the front spinner disk, attractive graphic designs, schematically indicated as 4 in FIGS. 5–7, can be displayed by these components.

The smaller diameter of the rear disk and a narrow gap 14 between the top track edge portion of track 1 and the rear disk peripheral edge 12 yields an additional advantage, because the magnets and the track segments can be made narrower than the segments would be if the rear disk 9 had a larger diameter; see FIG. 2.

Figure 5:
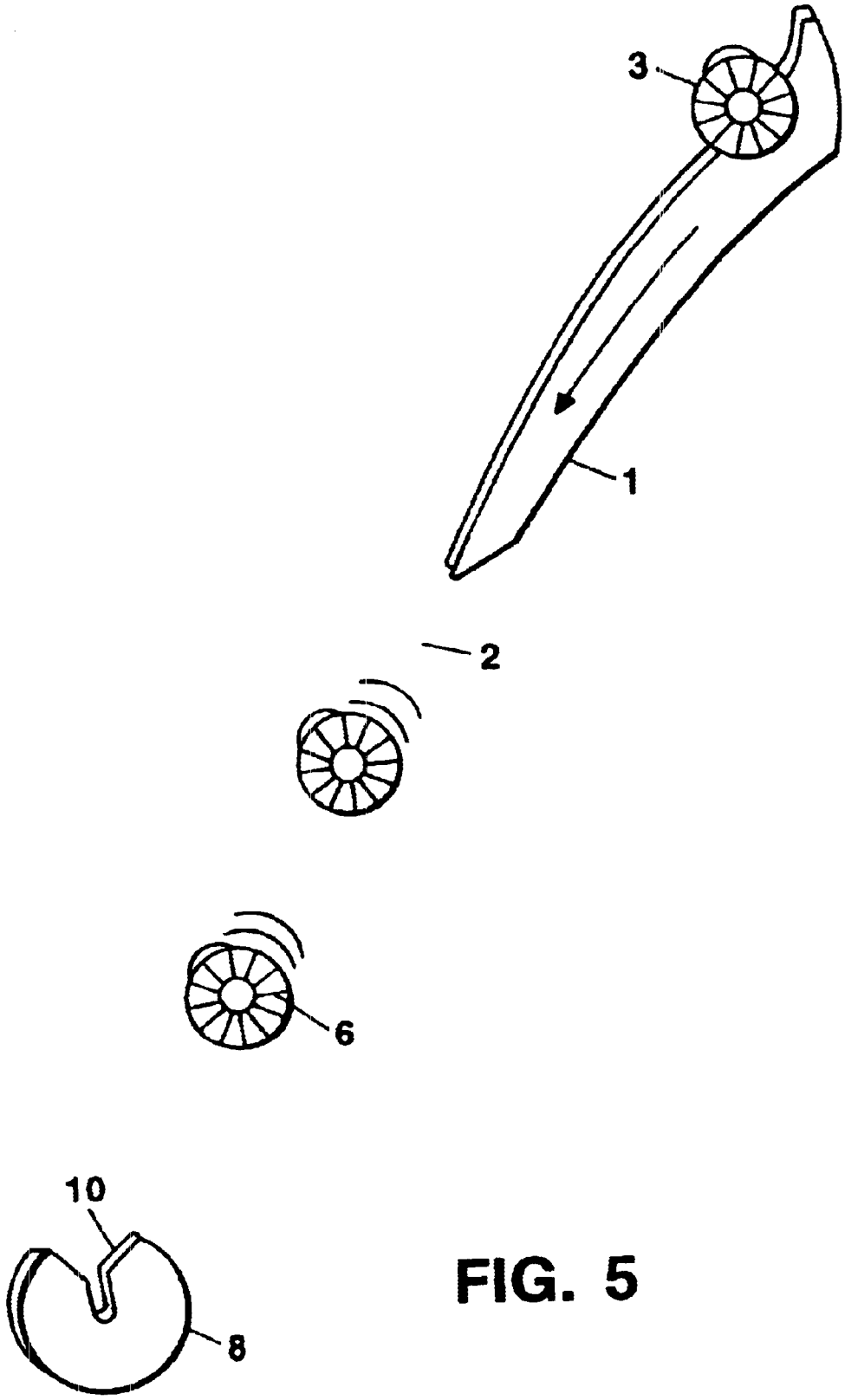
FIG. 5 shows a "Long Jump" track and target arrangement.
Figure 6:
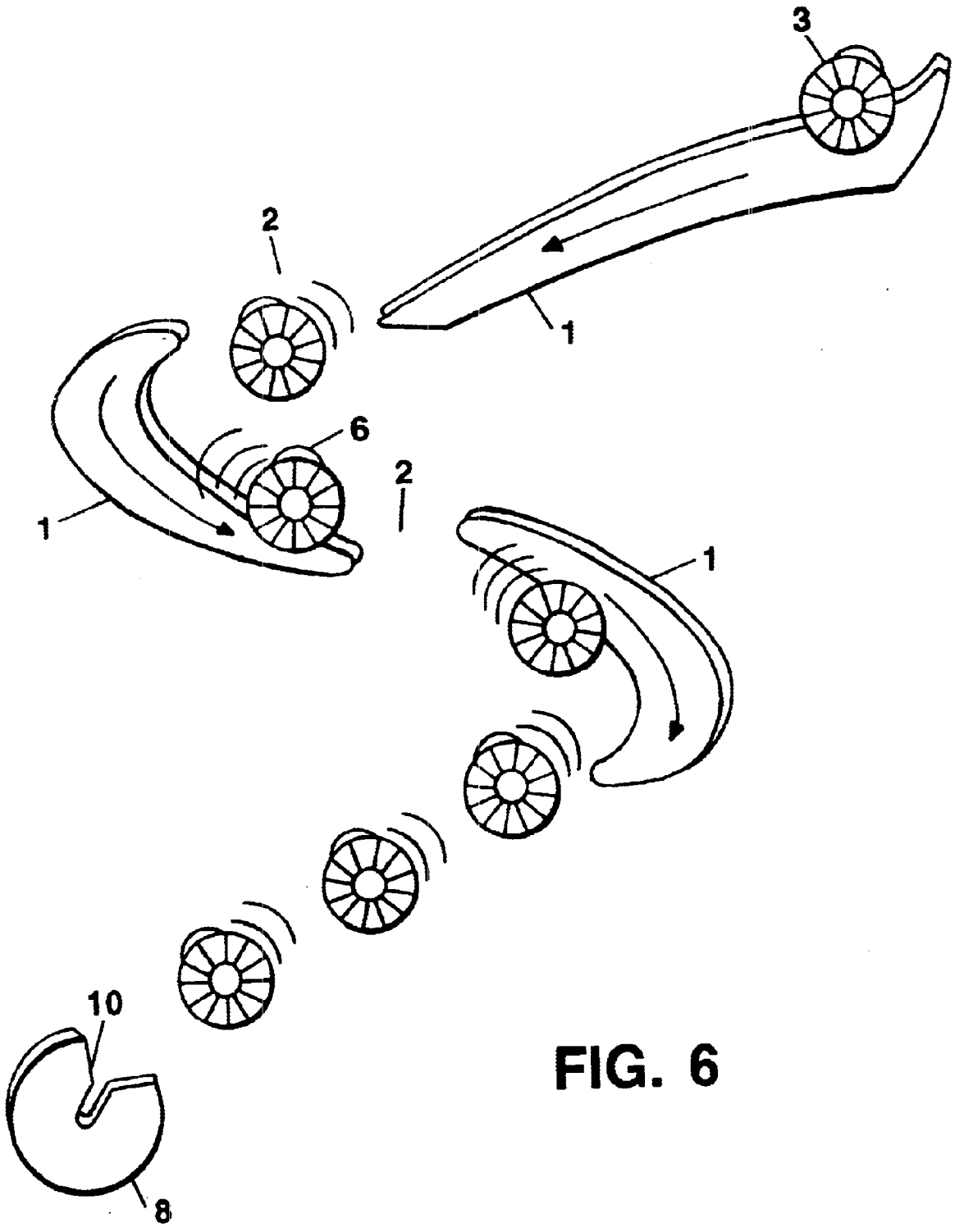
FIGS. 6 and 7 show typical arrangements of the track segments and target members.

Rotating spinner 3 travels down a number of track segments 1 shown in FIGS. 5 and 6, by the force of gravity, the spinner 3 jumping across gaps 4 between track segments, and yet remaining in an upright position to enable reliable transfer of the spinner across the gaps. This is accomplished by designing the back spinner disk 9 to have a weight that counterbalances the weight of the front spinner disk 7, for thwarting tilting of said spinner member which can otherwise result in the spinner "crashing" or failing to neatly traverse the gaps 4 between track segments 1 as it passes from one track segment to another. The axle 11 and the back disk 9 were preferably made of steel in the operating toy that I have constructed, and the larger front disk 7 is be made of less dense plastic to facilitate the aforesaid counterbalancing, whereby the weights of the unequally sized disks are approximately the same. Also, note the outwardly sloping beveled disk surfaces 13 and 15 facing each other, to aid in pulling the spinner into alignment with a track segment upon landing on a track after traversing a gap.

Figure 7:
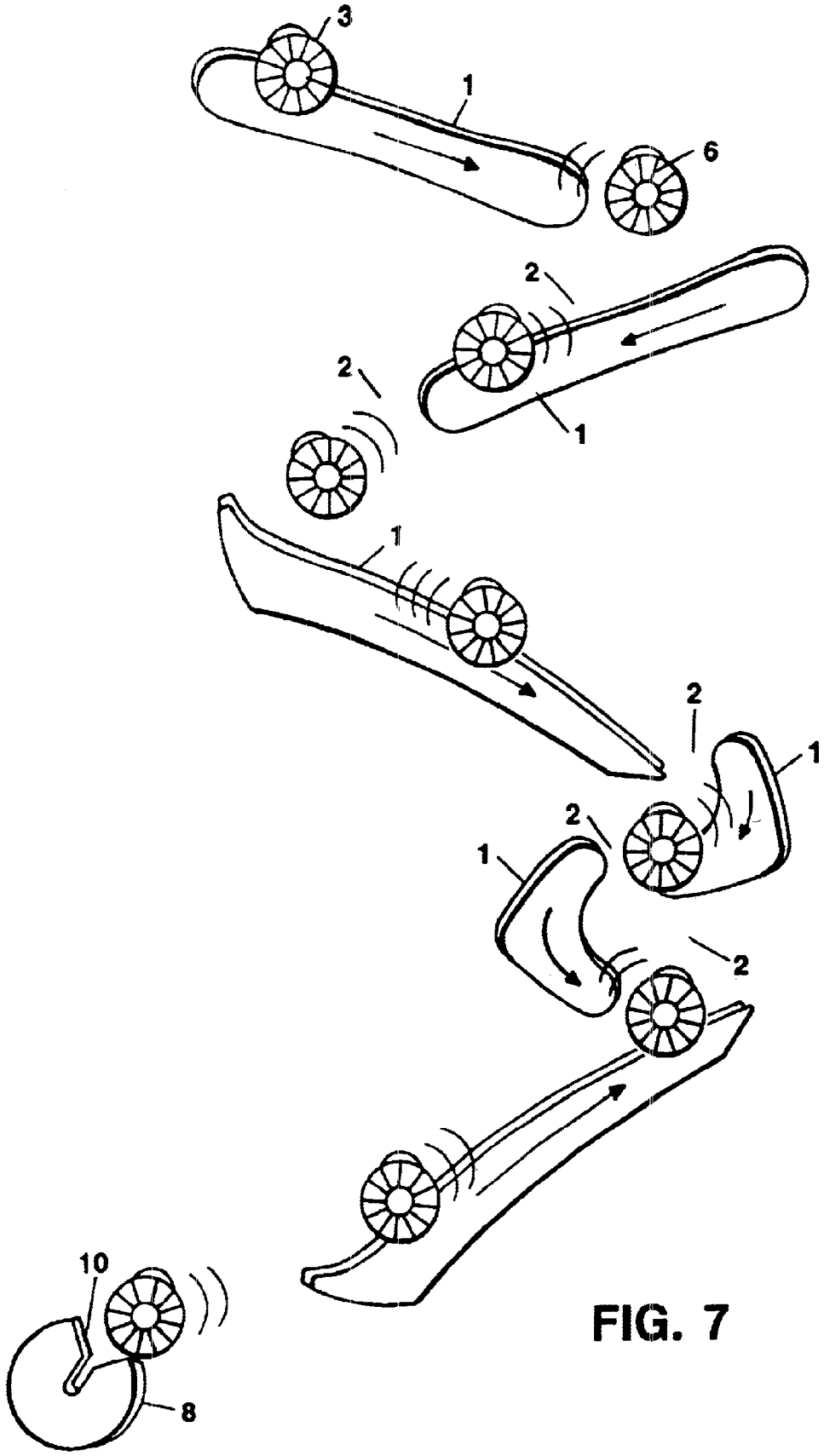

The flat front face of the spinner disk 7 is large to advantageously display a large graphic design 6 that appears to move as the spinner rotates about spinner axle 11 and descends down the tracks by the force of gravity. The design could, for example, comprise a rotating "star" motif shown in FIGS. 5–7 or spiral. A magnet backed target member 8 could be supplied, having a outwardly diverging opening such as a V-shaped orifice 10, to receive the spinner upon termination of its travel along track segments 1, as shown in FIGS. 5–7. The skill level can be changed by changing the number of track segments, the sizes of the gaps 2 between track segments I and/or the gap between the target member 8 and the lowermost track segment.

FIG. 5 shows a "long jump" arrangement, using a single track segment 1 having a large variable gap which can make targeting of the V shaped pocket 10 of target member 8 somewhat difficult. FIG. 6 shows an arrangement of "head-to-tail" tandem positioned curved track segments 1 having previously described components 3, 8 and 10. Note that if the top track segment is improperly aligned with the curved segment 1, spinner 2 will not land in the top curved segment. This introduces an additional level of required skill. FIG. 7 shows a more complex "Slalom" zig-zag track arrangement reminiscent of skiing down a ski slope. Since a number of possible arrangements may be created, this adds interest to the ownership of the toy.

The weight relationship between the front and back disks is that they are very roughly equal. The preferred relationship is that the weight of the rear disk is about ten percent heavier than the weight of the front disk. Also, the diameter of the axle is preferably 10–20 percent of the diameter of the front disk. Ideally, the depth of the top track portion is about 95% of the length of the exposed axle.

The positions of the vertically oriented track segments 1 are preferably maintained upon a vertical metallic surface such as a metallic refrigerator door by magnetic action. Flat magnets 5 are preferably mounted upon back surfaces of the track segments as shown in FIGS. 1 and 2, to hold the vertically oriented track segments against the refrigerator door. However other less preferred support means could employ, for example, an XY pegboard for receiving horizontally oriented pegs extending from the rear surfaces of the track segments. "Velcro" hook-and-eye fabrics could also be employed to vertically support the track segments.

Further variations of the foregoing will occur to the skilled worker in the art and thus the scope of the invention is to be limited solely by the terms of the following claims and art recognized equivalents thereof. For example, the term "disk" could include bodies at outer portions of the axle that are not round such as weighted members having square or hexagonal outlines. Also, less desired embodiments could even employ relatively thick weights separated by short axle segments. Radial extending co-planar members or rods, like the graphic "star" patterns shown in FIGS. 5–7, could be used in the spinner construction, rather than a conventional flat disk having a continuous periphery.

I claim:

1. A toy for altering the path of a spinner member being pulled downwardly by gravity comprising:

(a) a spinner member comprising a spin axle having a first disk affixed to a first portion of said spin axle and a second disk affixed to a second portion of said spin axle, said second disk having a weight that counterbalances the weight of said first disk for aiding in thwarting tilting of said spinner member;

(b) at least one track member for supporting the spin axle of said spinner member; and (c) positioning means for enabling said track member(s) to be vertically oriented in space.

2. The toy of claim 1 including a plurality of vertically oriented track members, at least one pair of track members being separated from each other to form a gap through which said spinner member can traverse.

3. The toy of claim 1 wherein said first disk has an outwardly facing surface and an inwardly facing sloping surface and wherein said second disk has an inwardly facing sloping surface, the sloping surfaces being configured to aid in thwarting tilting of said spinner member as it rides upon track members.

4. The toy of claim 2 wherein saidl first disk has an outwardly facing surface and an inwardly facing sloping surface and wherein said second disk has an inwardly facing sloping surface, the sloping surfaces being configured to aid in thwarting tilting of said spinner member as it rides upon track members.

5. The toy of claim 1 wherein said first and second disks are separated by a distance along the spin axle that is slightly greater than the width of top edge portions of said track members contacting said spin axle.

6. The toy of claim 2 wherein said first and second disks are separated by a distance along the spin axle that is slightly greater than the width of top edge portions of said track members contacting said spin axle.

7. The toy of claim 3 wherein said first and second disks are separated by a distance along the spin axle that is slightly greater than the width of top edge portions of said track members contacting said spin axle.

8. The toy of claim 4 wherein said first and second disks are separated by a distance along the spin axle that is slightly greater than the width of top edge portions of said track members contacting said spin axle.

9. The toy of claim 1 wherein said first disk has an outwardly facing front surface overlapping said track member and having a graphic design thereon not visually blocked by a track member.

10. The toy of claim 2 wherein said first disk has an outwardly facing front surface overlapping said track member and having a graphic design thereon not visually blocked by a track member.

11. The toy of claim 3 wherein said first disk has an outwardly facing front surface overlapping said track member and having a graphic design thereon not visually blocked by a track member.

12. The toy of claim 4 wherein said first disk has an outwardly facing front surface overlapping said track member and having a graphic design thereon not visually blocked by a track member.

13. The toy of claim 2 wherein said plurality of track members comprise thin flat track segments, and said positioning means comprise thin flat magnets on back surfaces thereof, enabling said track members to be vertically oriented in space.

14. A toy for altering the path of a spinner member being pulled downwardly by gravity comprising:

(a) a spinner member comprising a spin axle having a first disk of a given diameter affixed to a first portion of said spin axle and a second disk affixed to a second portion of said spin axle having a smaller diameter than the diameter of the first disk, said second disk made of a material having a greater density than material of said first disk for counterbalancing the weight of said first disk for aiding in thwarting tilting of said spinner member;

(b) at least one track member for supporting the spin axle of said spinner member; and (c) positioning means for enabling said track member(s) to be vertically oriented in space.

15. The toy of claim 14 including a plurality of vertically oriented track members, at least one pair of track members being separated from each other to form a gap through which said spinner member can traverse.

16. The toy of claim 14 wherein said first disk has an outwardly facing surface and an inwardly facing sloping surface and wherein said second disk has an inwardly facing sloping surface, the sloping surfaces being configured to aid in thwarting tilting of said spinner member as it rides upon track members.

17. The toy of claim 15 wherein said first disk has an outwardly facing surface and an inwardly facing sloping surface and wherein said second disk has an inwardly facing sloping surface, the sloping surfaces being configured to aid in thwarting tilting of said spinner member as it rides upon track members.

18. The toy of claim 14 wherein said first and second disks are separated by a distance along the spin axle that is slightly greater than the width of top edge portions of said track members contacting said spin axle.

19. The toy of claim 15 wherein said first and second disks are separated by a distance along the spin axle that is slightly greater than the width of top edge portions of said track members contacting said spin axle.

20. The toy of claim 16 wherein said first and second disks are separated by a distance along the spin axle that is slightly greater than the width of top edge portions of said track members contacting said spin axle.

21. The toy of claim 17 wherein said first and second disks are separated by a distance along the spin axle that is slightly greater than the width of top edge portions of said track members contacting said spin axle.

22. A toy for altering the path of a spinner member being pulled downwardly by gravity comprising:

(a) a spinner member comprising a spin axle having a first weighted body affixed to a first portion of said spin axle and a second weighted body affixed to a second portion of said spin axle, said second weighted body having a weight that counterbalances the weight of said first weighted body for aiding in thwarting tilting of said spinner member;

(b) at least one track member for supporting the spin axle of said spinner member; and (c) positioning means for enabling said track member(s) to be vertically oriented in space.

23. The toy of claim 22 including a plurality of vertically oriented track members, at least one pair of track members being separated from each other to form a gap through which said spinner member can traverse.

24. The toy of claim 22 wherein said first weighted body has an inwardly facing surface and wherein said second weighted body has an inwardly facing surface, the inwardly facing surfaces being configured to aid in thwarting tilting of said spinner member as it rides upon track members.

25. The toy of claim 23 wherein said first weighted body has an inwardly facing surface and wherein said second weighted body has an inwardly facing surface, the inwardly facing surfaces being configured to aid in thwarting tilting of said spinner member as it rides upon track members.

26. The toy of claim 1 including a target member having a diverging opening for receiving said spinner member.

27. The toy of claim 14 including a target member having a diverging opening for receiving said spinner member.

28. The toy of claim 22 including a target member having a diverging opening for receiving said spinner member.

* * * * *